US011898416B2

(12) United States Patent
Patil et al.

(10) Patent No.: US 11,898,416 B2
(45) Date of Patent: Feb. 13, 2024

(54) SHEARABLE DRIVE PIN ASSEMBLY

(71) Applicant: Halliburton Energy Services, Inc., Houston, TX (US)

(72) Inventors: Ishwar Dilip Patil, Spring, TX (US); Avinash Gopal Dharne, Houston, TX (US); Lonnie Carl Helms, Humble, TX (US); Frank Vinicio Acosta Villarreal, Spring, TX (US); Priyanshkumar Prashantkumar Desai, Stafford, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 6 days.

(21) Appl. No.: 17/466,419

(22) Filed: Sep. 3, 2021

(65) Prior Publication Data

US 2022/0364437 A1 Nov. 17, 2022

Related U.S. Application Data

(60) Provisional application No. 63/188,940, filed on May 14, 2021.

(51) Int. Cl.

| | |
|---|---|
| ***E21B 34/14*** | (2006.01) |
| ***E21B 34/10*** | (2006.01) |
| ***E21B 33/14*** | (2006.01) |

(52) U.S. Cl.

CPC ..... *E21B 34/103* (2013.01); *E21B 33/14* (2013.01); *E21B 34/14* (2013.01); *E21B 2200/06* (2020.05)

(58) Field of Classification Search

CPC ..... E21B 34/103; E21B 34/14; E21B 2200/06

See application file for complete search history.

(56) References Cited

U.S. PATENT DOCUMENTS

| | | | |
|---|---|---|---|
| 3,789,926 | A | 2/1974 | Henley et al. |
| 3,948,322 | A | 4/1976 | Baker |
| 4,487,263 | A | 12/1984 | Jani |
| 4,674,569 | A | 6/1987 | Revils et al. |
| 5,024,273 | A | 6/1991 | Coone et al. |
| 5,279,370 | A | 1/1994 | Brandell et al. |
| 5,411,095 | A | 5/1995 | Ehlinger et al. |
| 5,443,124 | A | 8/1995 | Wood et al. |
| 5,647,434 | A | 7/1997 | Sullaway et al. |
| 5,765,641 | A | 6/1998 | Shy et al. |
| 6,026,903 | A | 2/2000 | Shy et al. |
| 6,244,342 | B1 | 6/2001 | Sullaway et al. |
| 6,257,339 | B1 | 7/2001 | Haugen et al. |

(Continued)

FOREIGN PATENT DOCUMENTS

EP 1262629 A1 12/2002

OTHER PUBLICATIONS

Halliburton Catalog titled "Casing Equipment" (2015), entire catalog.

(Continued)

*Primary Examiner* — Catherine Loikith

(74) *Attorney, Agent, or Firm* — McAfee & Taft

(57) ABSTRACT

A downhole tool for use in a well comprising a mandrel and an outer sleeve slidably disposed about the mandrel. An inner sleeve is slidably disposed in the mandrel. A drive pin comprising a drive pin bushing connected to the outer sleeve and a shear pin connected to the inner sleeve connects the inner sleeve to the outer sleeve.

20 Claims, 9 Drawing Sheets

(56) References Cited

U.S. PATENT DOCUMENTS

| | | | |
|---|---|---|---|
| 6,425,442 | B1 | 7/2002 | Latiolais, Jr. et al. |
| 6,796,377 | B2 | 9/2004 | Butterfield, Jr. et al. |
| 6,802,373 | B2 | 10/2004 | Dillenbeck et al. |
| 7,237,611 | B2 | 7/2007 | Vincent et al. |
| 7,857,052 | B2 | 12/2010 | Giroux et al. |
| 7,866,402 | B2 | 1/2011 | Williamson, Jr. |
| 8,215,404 | B2 | 7/2012 | Makowiecki et al. |
| 8,616,276 | B2 | 12/2013 | Tips et al. |
| 8,646,537 | B2 | 2/2014 | Tips et al. |
| 8,720,561 | B2 | 5/2014 | Zhou |
| 9,010,442 | B2 | 4/2015 | Streich et al. |
| 9,121,255 | B2 | 9/2015 | Themig et al. |
| 9,291,007 | B2 | 3/2016 | Darbe et al. |
| 9,441,440 | B2 | 9/2016 | Hofman et al. |
| 9,441,446 | B2 | 9/2016 | Fripp et al. |
| 9,506,324 | B2 | 11/2016 | Kyle et al. |
| 9,587,486 | B2 | 3/2017 | Walton et al. |
| 9,816,351 | B2 | 11/2017 | Lirette et al. |
| 9,920,620 | B2 | 3/2018 | Murphree et al. |
| 10,024,150 | B2 | 7/2018 | Andreychuk et al. |
| 10,316,619 | B2 | 6/2019 | de Oliveira et al. |
| 10,358,914 | B2 | 7/2019 | Roberson et al. |
| 10,557,329 | B2 | 2/2020 | Gao et al. |
| 11,280,157 | B2 | 3/2022 | Acosta et al. |
| 11,293,253 | B2 | 4/2022 | Santoso et al. |
| 2006/0207765 | A1 | 9/2006 | Hofman |
| 2007/0261850 | A1 | 11/2007 | Giroux et al. |
| 2008/0251253 | A1 | 10/2008 | Lumbye |
| 2009/0071655 | A1 | 3/2009 | Fay |
| 2009/0151960 | A1 | 6/2009 | Rogers et al. |
| 2010/0051276 | A1 | 3/2010 | Rogers et al. |
| 2010/0163253 | A1 | 7/2010 | Caldwell et al. |
| 2010/0224372 | A1 | 9/2010 | Stowe et al. |
| 2013/0048290 | A1 | 2/2013 | Howell et al. |
| 2013/0233570 | A1 | 9/2013 | Acosta et al. |
| 2013/0233572 | A1 | 9/2013 | Helms et al. |
| 2014/0151025 | A1 | 6/2014 | Harms et al. |
| 2015/0027706 | A1 | 1/2015 | Symms |
| 2015/0184489 | A1 | 7/2015 | Resweber |
| 2016/0230505 | A1 | 8/2016 | Garcia et al. |
| 2017/0145784 | A1 | 5/2017 | Zhou |
| 2019/0010768 | A1 | 1/2019 | Cosse |
| 2019/0017366 | A1 | 1/2019 | Alaas et al. |
| 2019/0249549 | A1 | 8/2019 | Fripp et al. |
| 2020/0270967 | A1 | 8/2020 | Fong et al. |
| 2021/0010345 | A1 | 1/2021 | Acosta et al. |
| 2022/0364421 | A1* | 11/2022 | Nguyen ..... E21B 17/06 |
| 2022/0389773 | A1* | 12/2022 | Pye ..... E21B 17/06 |

OTHER PUBLICATIONS

Halliburton Brochure, "CEMENTING ES II Stage Cementer," Feb. 2009.

Halliburton Brochure, "Fidelis Stage Cementer," Sep. 2013.

International Search Report and Written Opinion dated Apr. 5, 2021, in PCT Application No. PCT/US2020/053694.

International Search Report and Written Opinion dated Jun. 20, 2022, issued in PCT Application No. PCT/US2022/020696.

* cited by examiner

SHEARABLE DRIVE PIN ASSEMBLY

BACKGROUND

When completing a subterranean well, casing is typically inserted into the wellbore and secured in place by injecting cement within the casing. The cement is forced through a lower end of the casing and into an annulus between the casing and wellbore wall. A displacement fluid is pumped into the casing above a plug to urge the plug downward through the casing to extrude the cement from the casing outlet and back up into the annulus. In some instances, it is impossible or impractical to cement the entire well.

To overcome the problems of a single stage cement process, the casing string is cemented in sections, which is known as a staging process. Staging involves placing cement staging tools integral within the casing string; the staging tools allow cement to flow downward therethrough to a lower section of the casing string during primary or first stage cementing operations. When the portion of the casing string below the particular staging tool is cemented to the well, the staging tool will divert cement into the surrounding annulus where the cement can flow upwards in the annulus.

Typically, a pin will connect inner and outer sleeves on a mandrel, so that movement of the inner sleeve will move the outer sleeve as well. The pin will transfer the load to set a packer on the tool, and thereafter will shear to allow further movement of the inner sleeve.

BRIEF DESCRIPTION OF THE DRAWINGS

FIG. 9 is a cross section of the cementing tool of FIG. 5 after the plugs have been drilled out.

DESCRIPTION OF AN EMBODIMENT

Figure 1:
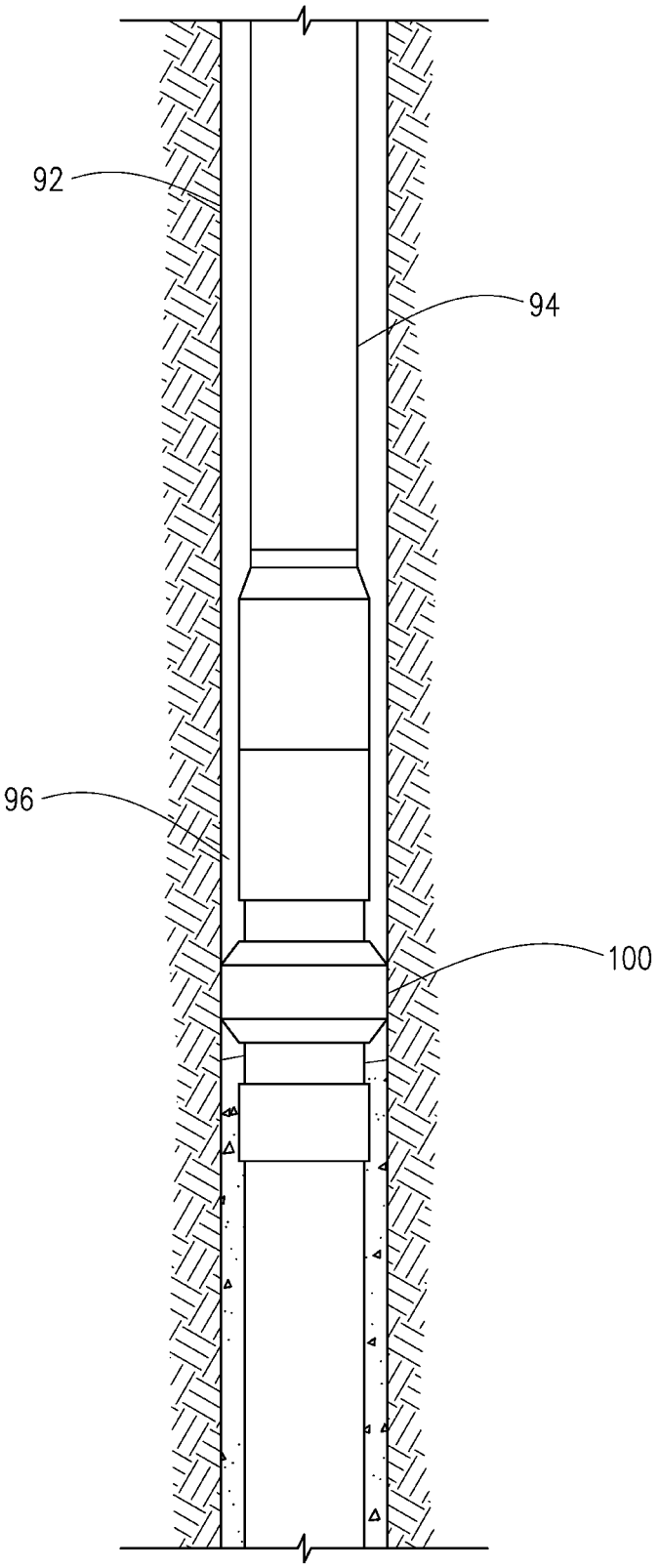
FIG. 1 is a schematic showing a stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis.

Figure 2:
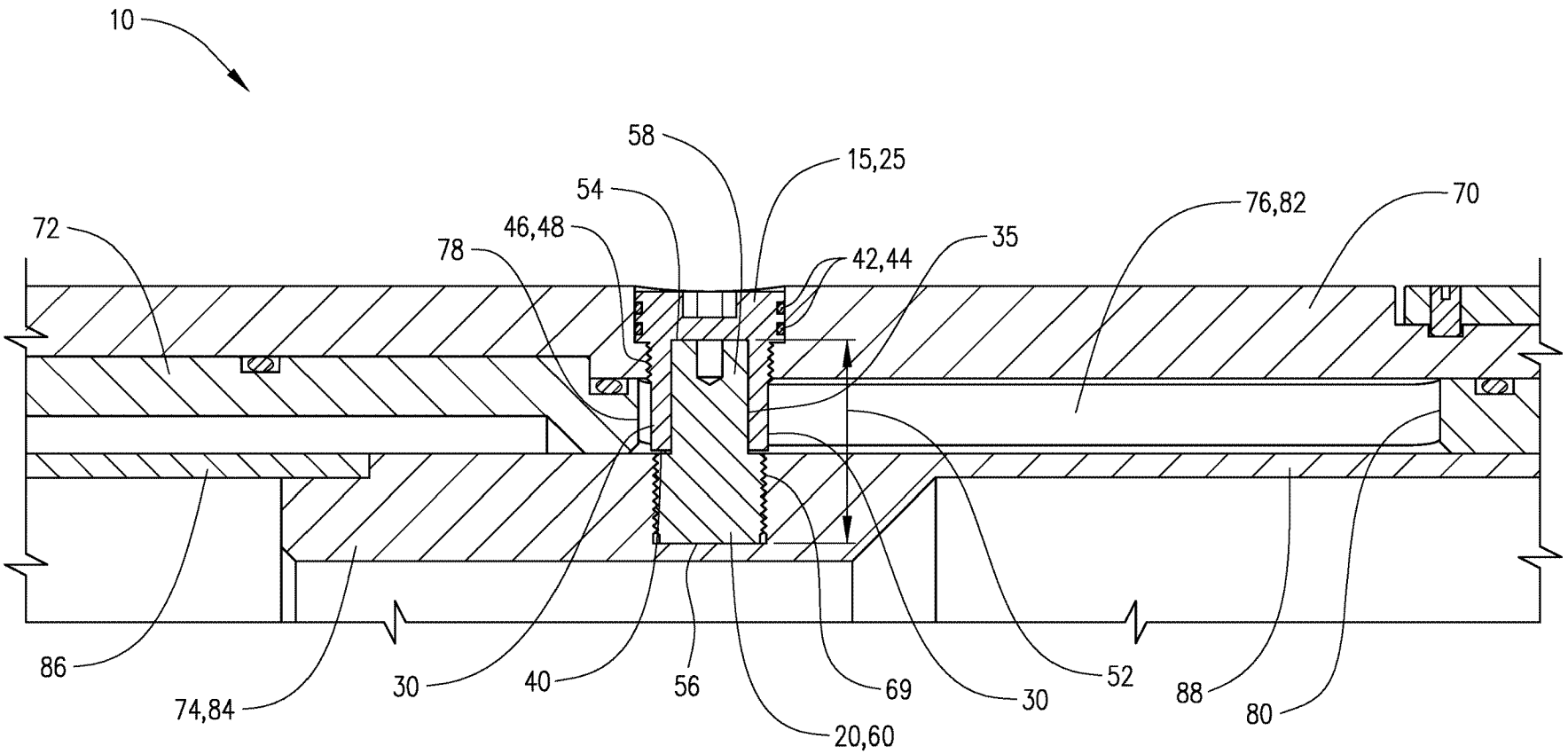
FIG. 2 is a cross section of a shearable drive pin assembly in a tool in a first, or run-in position.
Figure 3:
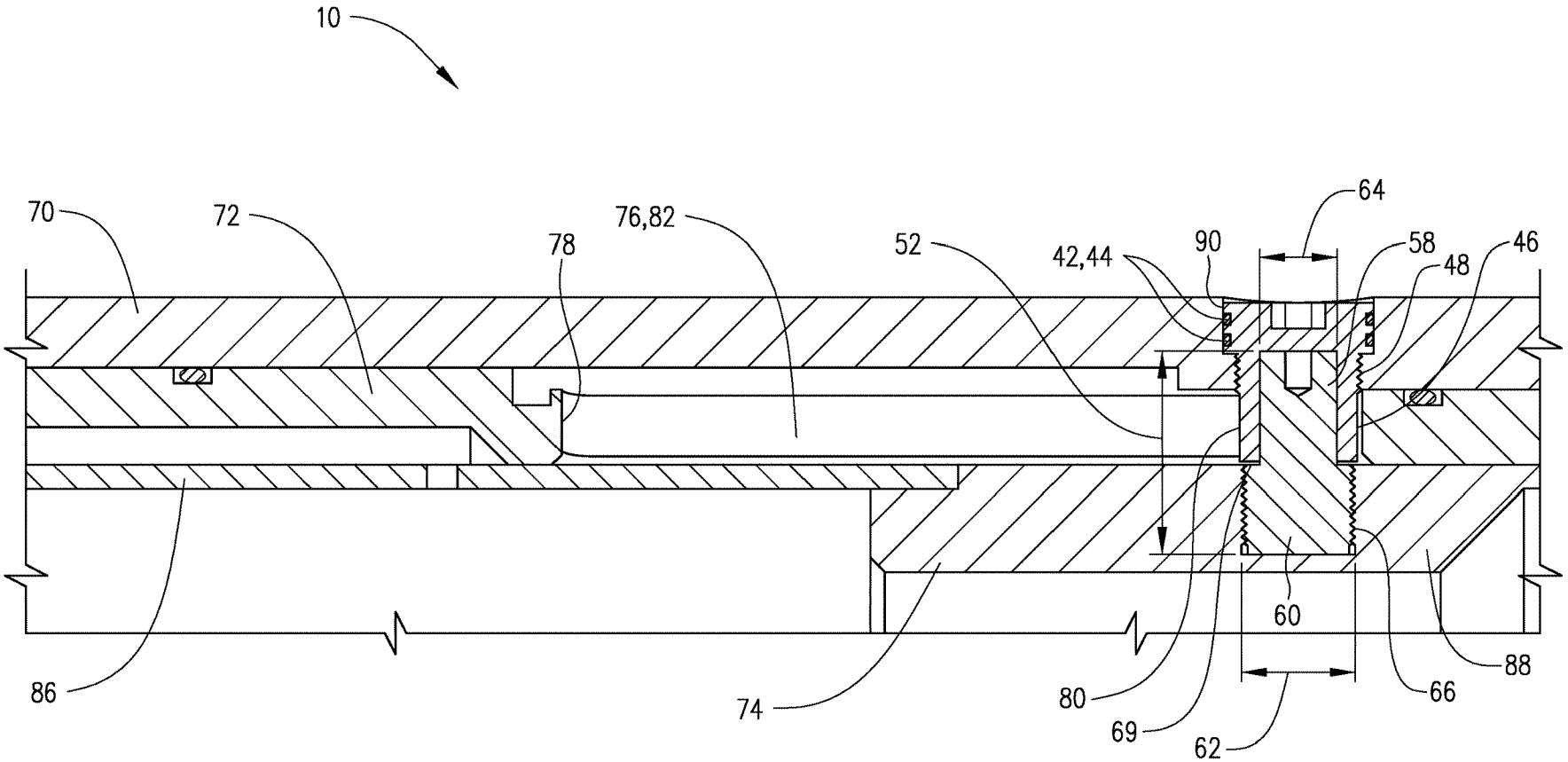
FIG. 3 is a cross section of the shearable drive pin assembly in a tool in a second, or intermediate position.
Figure 4:
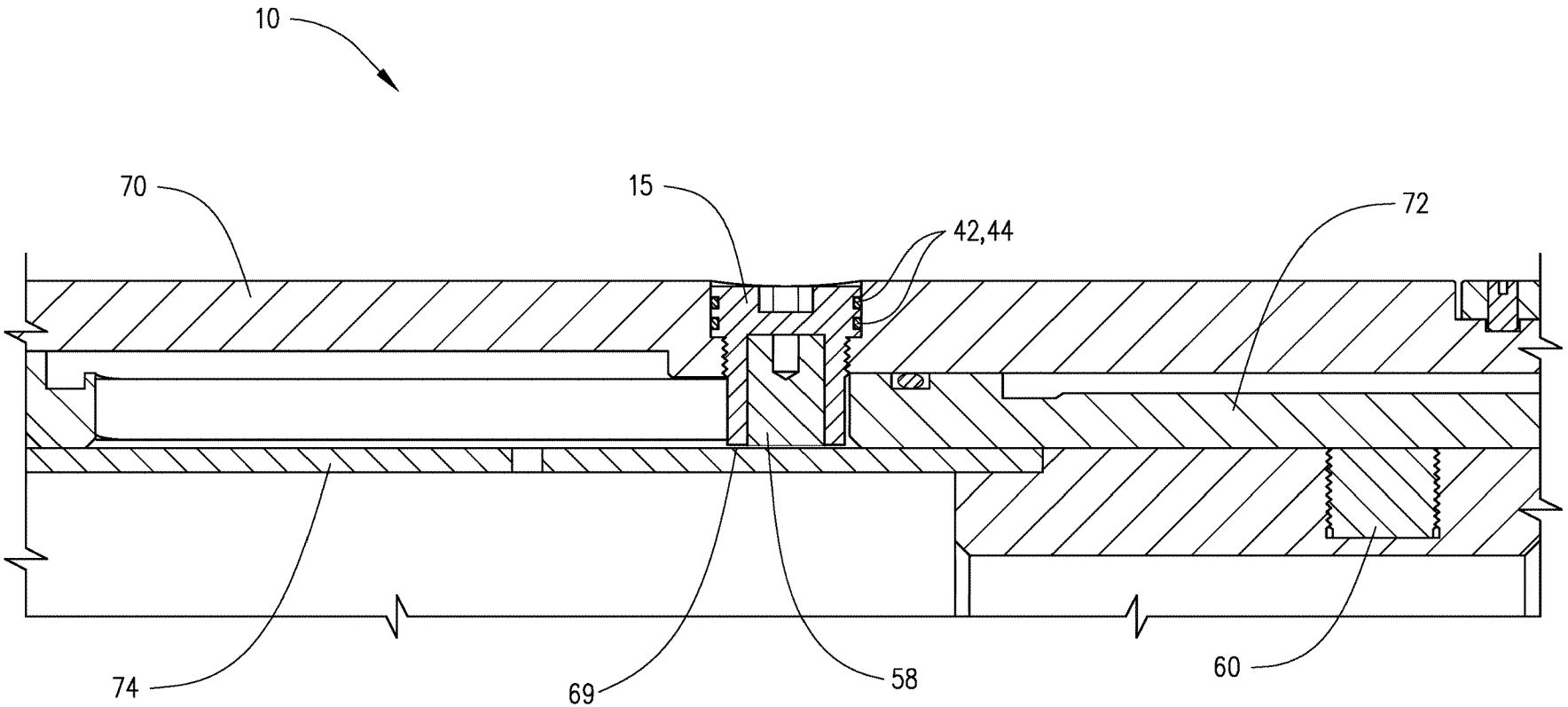
FIG. 4 is a cross section of the shearable drive pin assembly in a tool in a third or final position.

An embodiment of a drive pin assembly 10 is shown in FIGS. 2-4. Pin assembly 10 is a multiple piece pin assembly that comprises a drive pin bushing 15 which may be a flanged drive pin bushing 15 and a shear pin 20. The drive pin assembly overcomes certain disadvantages that may exist with a single piece shear pin. For example, in some cases, as will be described herein, the shear pin must traverse an open space. In such cases the pin may bend in that space prior to shearing and thus may create a bulge or a burr which can prevent proper actuation of a tool. The drive pin assembly 10 defines a shear plane such that when the shear pin shears, it shears across that plane and is a smooth surface thus eliminating the risk of any burrs or bulges that might create damage or inhibit the proper operation of a tool.

Drive pin bushing 15 is in one embodiment a flanged bushing that comprises a cap or cap portion 25 with a flange 30 extending therefrom. Flange 30 defines a generally cylindrical opening 35 and has a flange end 40. Cap 25 has O-rings 42 placed in grooves 44 therein. An outer surface 46 of drive pin bushing 15 may have threads 48 thereon. In the embodiment described, threads 48 are on the outer surface 46 of flange 30.

Shear pin 20 has a length 52 that extends from a first end 54 to a second end 56. Length 52 is sufficient such that when shear pin 20 is inserted into flange 30, second end 56 extends beyond flange end 40. In one embodiment, shear pin 20 has a shank 58 extending from a head 60. A diameter 62 of the head 60 is greater than a diameter 64 of shank 58. Head 60 and shank 58 define a shoulder 66. A shear plane 68 is defined by a small space 69 between flange end 40 and shoulder 66. The shear plane 68 results in a clean break, with no burrs or bulges that might create damage, or that might prevent proper operation of a tool.

FIGS. 2-4 show drive pins 10 utilized with an outer sleeve 70 disposed about a mandrel 72. An inner sleeve 74 is slidably disposed in mandrel 72. Mandrel 72 has a longitudinally extending slot 76 extending from an upper end 78 and lower end 80. Drive pin assembly 10 will travel within longitudinal slot 76. The existence of slot 76 creates a space 82 between outer sleeve 70 and inner sleeve 74. Drive pin assembly 10 will traverse space 82. In one embodiment inner sleeve 74 has an increased thickness boss portion 84. Inner sleeve 74 in some cases may be a two-piece inner sleeve that comprises an upper sleeve portion 86 and lower sleeve portion 88. The drive pin bushing 15 provides sufficient strength to carry the load necessary to urge outer sleeve 70 down to actuate a tool therebelow, for example to set a packer. Drive pin bushing 15 also helps to dictate the shear plane 68 on shear pin 20. Shear plane 68 provides a clean break that allows the shear pin 20 after shearing to slide along mandrel 72 without creating damage or interfering with proper operation. In other words, after shearing, the plane 68 along which shear pin 20 breaks will be smooth and will slide easily against mandrel 72. The risk of bending is alleviated, since it is the drive pin bushing 15 that traverses the majority of space 82, leaving only small space 69 for shear pin 20 to shear. In one embodiment the drive pin bushing 15 may be made, for example, from a high strength stainless steel, while the shear pin 20 will be a softer material that will shear at a predetermined load. Non-limiting examples of material that may be used for shear pin 20 include brass, bronze, a mild steel, plastic and aluminum.

The operation of a tool including the drive pin 10 may comprise for example, lowering the tool into a wellbore in a first, or run-in position like that shown in FIG. 2. Inner sleeve 74 is in a first position. Pressure can be applied by dropping a plug, or a ball to engage inner sleeve 74 and urge sleeve 74 downwardly to a second position as shown in FIG. 3. Outer sleeve 70 will move with inner sleeve 74 to a second position on the outer surface of mandrel 72 as a result of the connection by drive pins 10. Moving the inner and outer sleeves 74 and 70 to the second position will actuate a tool therebelow, for example setting a packer. Pressure can be increased after the packer is set to cause shear pin 20 to break along shear plane 68 and allow inner sleeve 74 to move relative to the mandrel 72 and the outer sleeve 70. The downward movement of inner sleeve 74 may for example open communication between a central flow passage of the tool and an annulus outside the tool to provide for a cementing or other operation.

The use of a pin assembly 10 alleviates a risk of damage and/or improper operation of downhole tools. The assembly operation is likewise simplified. The shear pin 20 is passed through an opening 90 in outer sleeve 70 in which drive pin bushing 15 is ultimately positioned. Head 60 of shear pin 20 may be threaded into inner sleeve 74. Flange 30 of drive pin bushing 15 is then inserted through opening 90 to extend over shank 58 and is threaded to outer sleeve 70. Threads 48 are positioned on flange 30 such that when drive pin bushing 15 is threaded into outer sleeve 70, O-rings 42 create a seal that will prevent communication from a bore or central flow passage of inner sleeve 74 to an annulus defined between the outer sleeve 70 and a wellbore wall.

Figure 5:
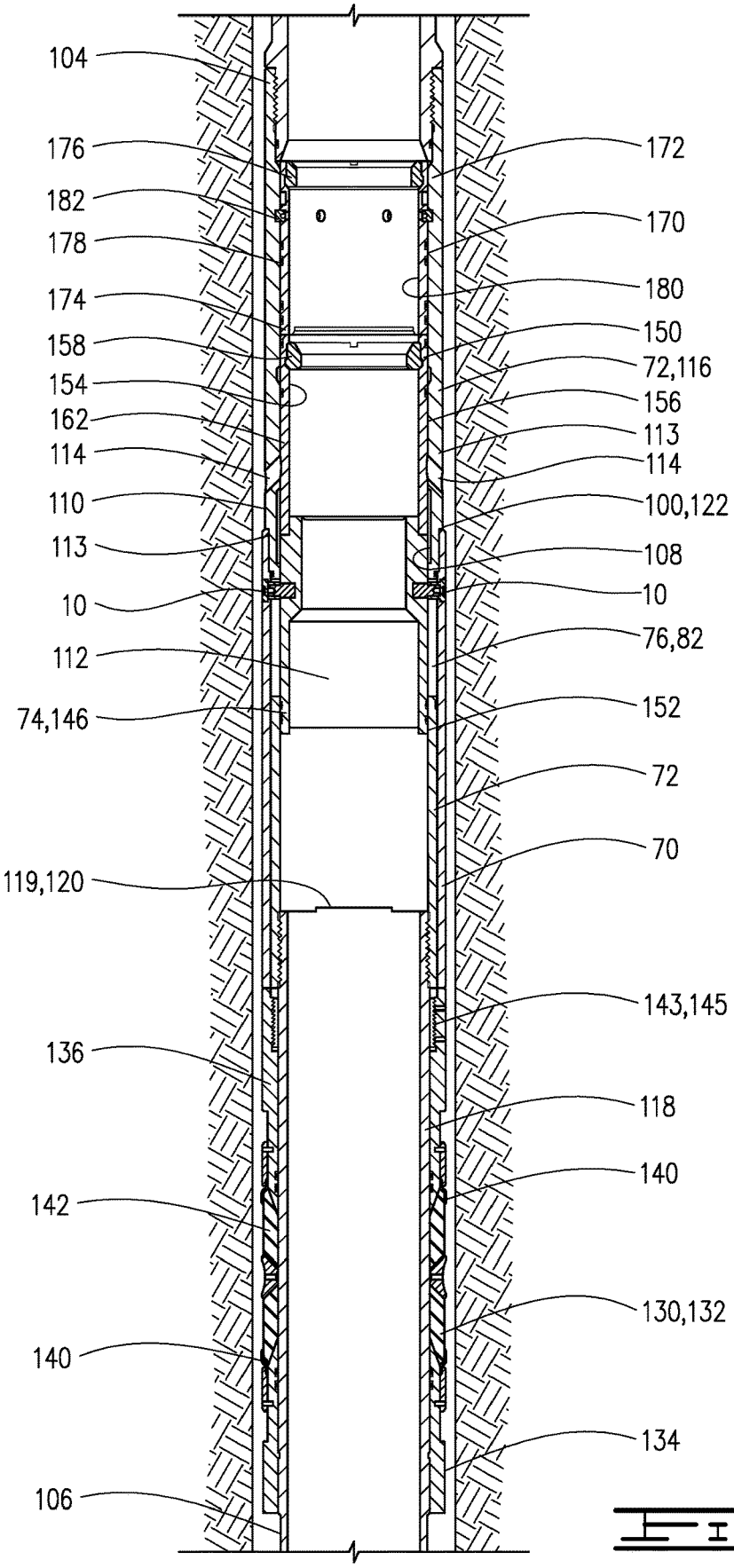
FIG. 5 is a cross section of a cementing tool in a run-in position.
Figure 6:
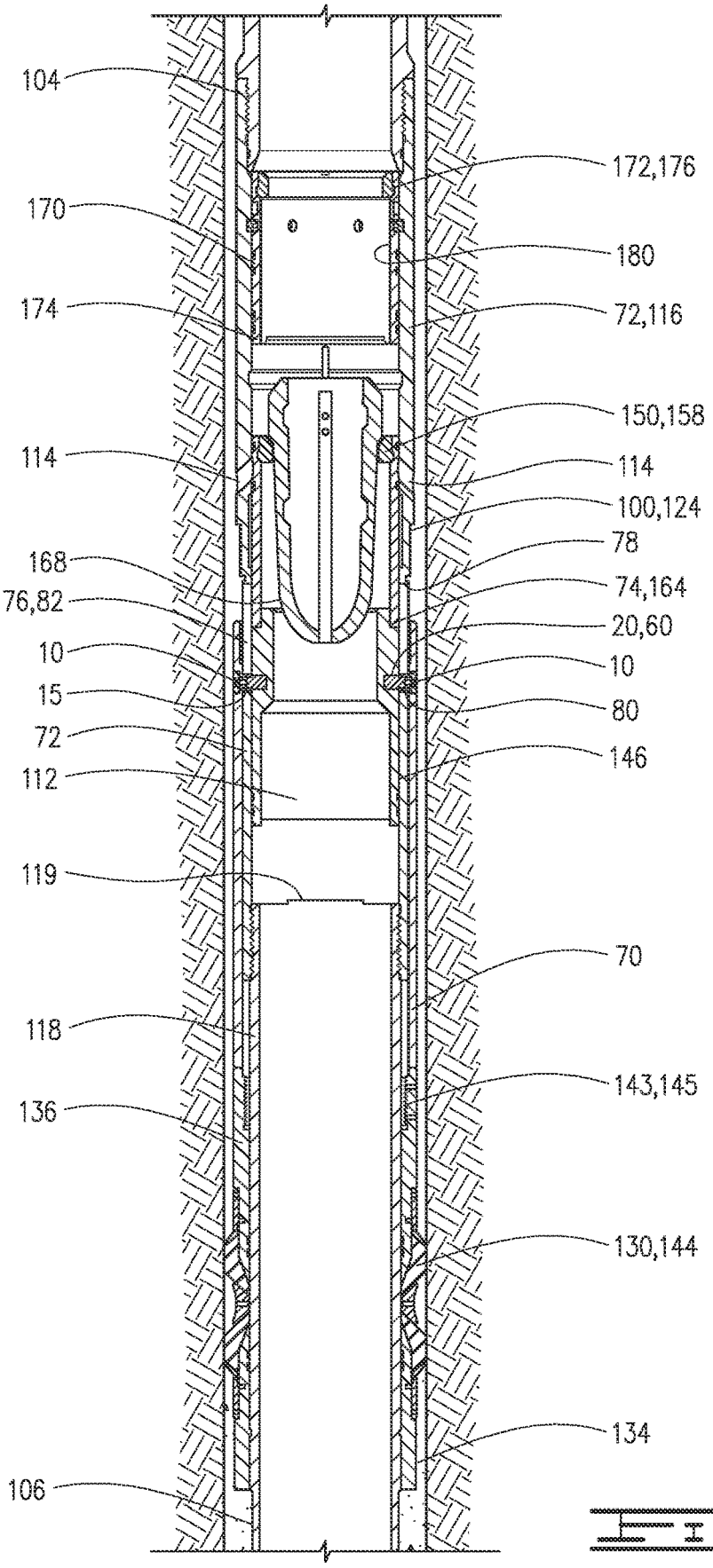
FIG. 6 is a cross section of the cementing tool of FIG. 5 in a set position.
Figure 7:
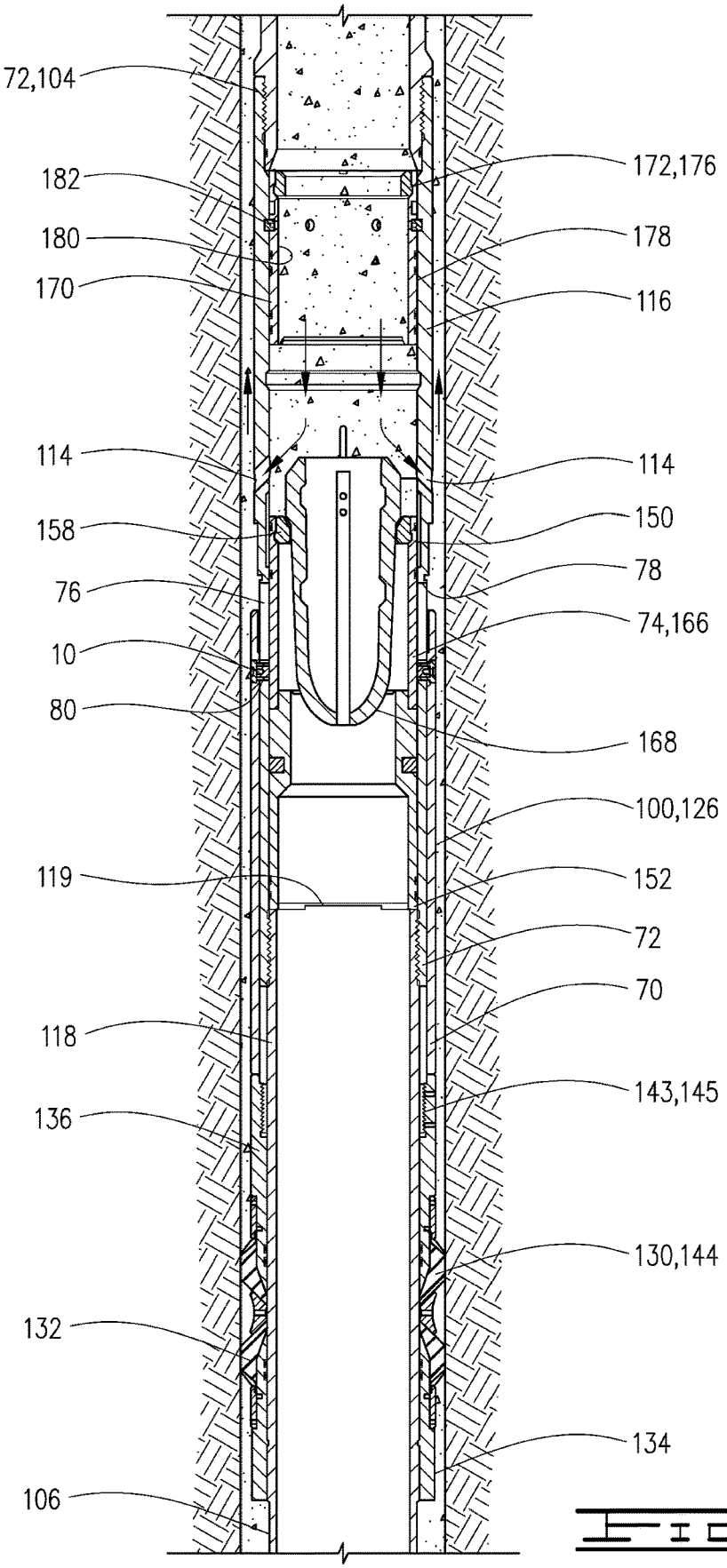
FIG. 7 is a cross section of the cementing tool of FIG. 5 in a cementing position.

An exemplary tool 100 in which drive pin assembly 10 may be utilized is shown in FIGS. 5-7. Tool 100 is shown lowered into a wellbore 92 on casing 94. Annulus 96 is defined by and between tool 100 and a wellbore wall 98.

Stage cementing tool 100 comprises mandrel 72 with upper end 104, lower end 106, inner surface 108 and an outer surface 110. Mandrel 72 defines a central flow passage 112 therethrough and a plurality of cement flow ports 114 in a wall 113 thereof. A plurality of longitudinal slots 76 are defined in mandrel wall 113. Mandrel 72 may comprise a two-piece mandrel with upper mandrel 116 and lower mandrel 118 connected thereto. An upper end 119 of lower mandrel portion 118 may have an anti-rotation profile defined thereon. Stage cementing tool 100 is shown in a first or run-in position 122 in FIG. 5 and a set, intermediate position 124 in FIG. 6. The third, or cementing position 126 is shown in FIG. 7.

A packer 130 comprising a packer element 132 or a plurality of packer elements 132 is disposed about mandrel 72. Packer assembly 130 comprises a fixed wedge 134 that is stationary on mandrel 72 and a setting wedge 136. Setting wedge 136 is slidable relative to mandrel 72. Outer sleeve 70, which may be referred to as a setting sleeve 70 may be integrally formed with or connected to a separate setting wedge 136. Packer shoes 140 are disposed at upper and lower ends of packer elements 132. Packer 130 is movable from an unset position 142 to the set position 144 shown in FIG. 6. Once packer 130 is moved to the set position setting wedge 136 will be restrained from moving upwardly. A body lock ring 143 is connected to and will move with setting sleeve 70. Body lock ring 143 is disposed in an annulus 145 defined by and between setting sleeve 70 and mandrel 72. Body lock ring 143 will engage a series of teeth defined on the outer surface 110 of mandrel 72 and will lock setting sleeve 70 and setting wedge 136 in place once the packer 130 is in the set position.

A cementing valve 146 comprises inner sleeve 74, also referred to as an opening sleeve 74, disposed in mandrel 72. Opening sleeve 74 has upper end 150, lower end 152, an inner surface 154 and an outer surface 156. An opening seat 158 is defined at the upper end 150 of opening sleeve 74. Opening seat 158 may be a separate piece that is connected to opening sleeve 74 or may be integrally formed therewith. A plurality of shearable drive pins 10 are connected to opening sleeve 74 and extend through longitudinal slots 76. Shearable drive pins 10 are likewise connected to setting sleeve 70. Opening sleeve 74 is shown in the run-in position 162 in FIG. 5, a set position 164 in FIG. 6, and an open or cementing position 166 in FIG. 7. Once in the open position 166, the opening sleeve 74 does not move downward any further. O-ring seals 42 on drive pins 10 will provide a seal to prevent communication between central flow passage 112 and annulus 96 in the first position of the inner and outer sleeves 74 and 70.

An opening plug 168 is displaced into casing 94 once the prior stage cementing is complete. The opening plug 168 will engage opening seat 158 and pressure will be increased to cause the opening sleeve 74 to move downwardly. The opening sleeve will cause the outer, or setting sleeve 70 to move downwardly. Setting sleeve 70 will move downwardly with opening sleeve 74 to move packer 130 into the set position which is the set position of the stage cementing tool 100. The drive pin bushing 15 will transfer the load required to move outer sleeve 70 down on mandrel 72 and set the packer. When stage cementing tool 100 is initially moved to the set position, flow through ports 114 is still blocked by inner sleeve 74. An increase in pressure above opening plug 168 causes drive pins 10 to break and allow inner opening sleeve 74 to move downwardly relative to outer sleeve 70 and mandrel 72 to the cementing position as shown in FIG. 9. Cement can then be flowed downwardly through central flow passage 112 and communicated to annulus 96 through cement flow ports 114. As previously described, drive pins 10 will break along shear plane 68. The shear plane 68 will easily slide along the inner surface of mandrel 72 after the shear pin 20 has sheared and inner sleeve 74 moves downwardly in mandrel 72. As a result, there is a clean break such that no damage occurs, and no interruption with the proper operation of the tool. No bending will occur since the drive pin bushing 15 traverses much of the space 82 between the inner sleeve 74 and outer sleeve 70, except for the small space 69 across which shear pin 20 shears.

A closing sleeve 170 is disposed in mandrel 72 and is detachably connected thereto. Closing sleeve 170 has upper end 172, lower end 174, and defines a closing seat 176 at the upper end 172 thereof. Closing seat 176 may be a separate piece connected to closing sleeve 170 or may be integrally formed therewith. Closing sleeve 170 has outer surface 178 and inner surface 180. The closing sleeve 170 is detachably connected to mandrel 72 with shear pins 182.

Figure 8:
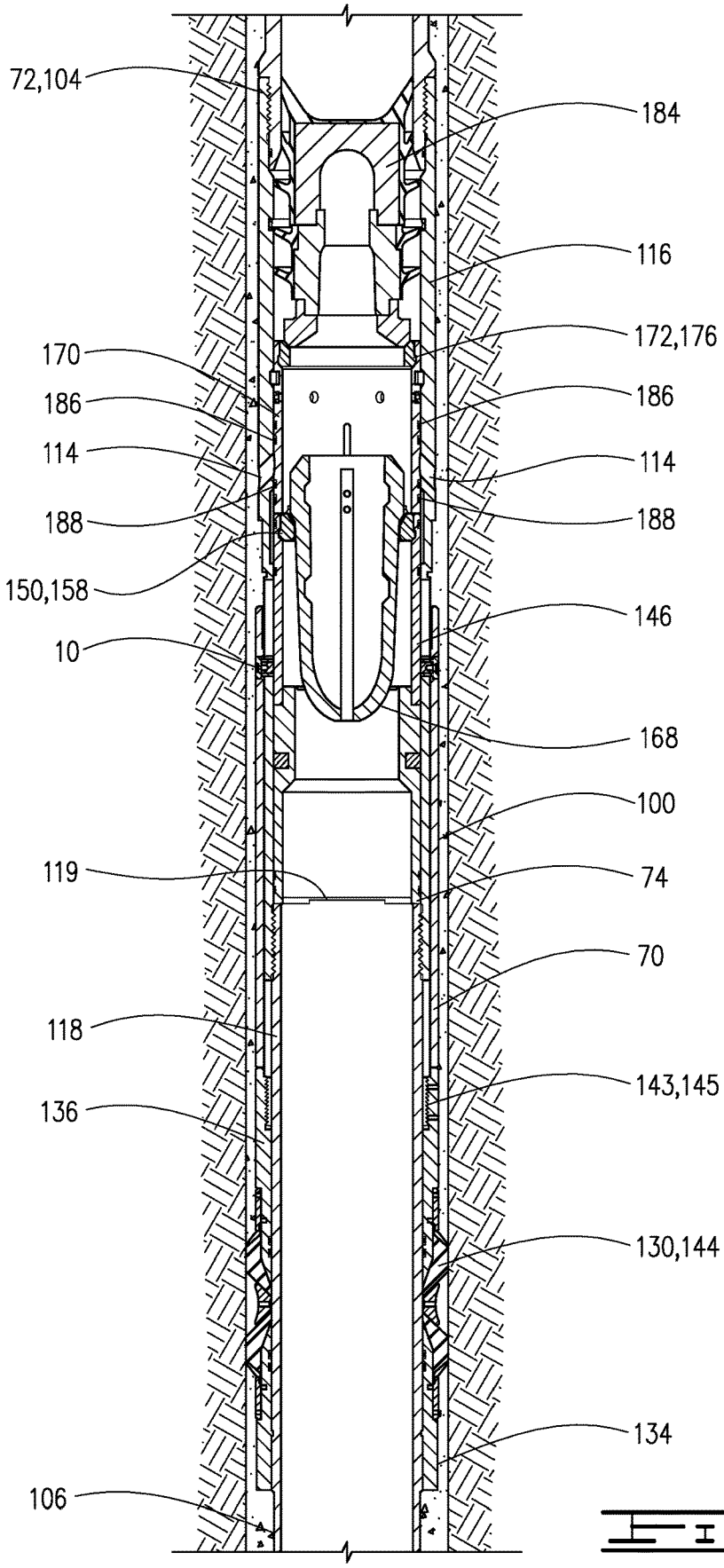
FIG. 8 is a cross section of the cementing tool of FIG. 5 in a closed or completed position.
Figure 5:
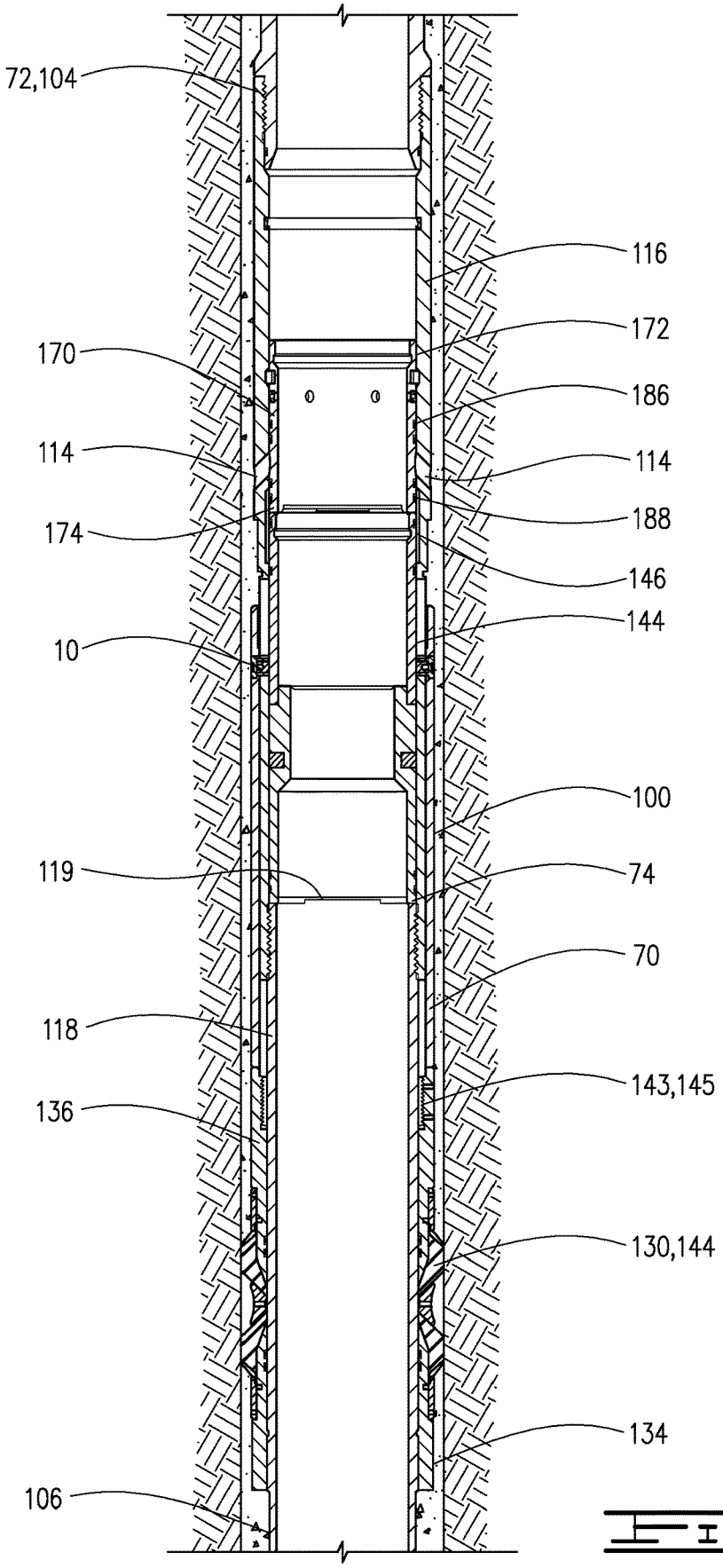

Once a desired amount of cement has been displaced into casing 94 and out through cement flow ports 114, closing plug 184 will be displaced into casing 94 at the trailing edge of cement. Closing plug 184 will engage closing seat 176. Pressure will be increased until shear pins 182 are broken and closing sleeve 170 moves from its first position shown in FIG. 7 to its second position shown in FIG. 8, which is the completed position of the stage cementing tool 100. In that position, flow through cement flow ports 114 to annulus 96 is prevented as a result of sealing engagement of closing sleeve 170 with the inner surface 108 of mandrel 72. Closing sleeve 170 may have a plurality of spaced-apart seals 186 above cement flow ports 114 and a plurality of seals 188 below cement flow ports 114 in the completed position which will sealingly engage mandrel 72. If desired, the closing plug and opening plug can be drilled out thereafter to provide for a clean full bore passageway as depicted in FIG. 9.

Although drive pins 10 have been described in use with a cementing tool, it is understood that use is not restricted to such a use. Drive pin 10 can be used with any tool that requires an initial movement to transfer a load and actuate a tool, such as a packer, and thereafter requires additional movement of only one of the sleeves to which the drive pins 10 were originally connected to actuate another operation, such as opening a flow port. Embodiments may include the following.

Embodiment 1. A downhole tool for use in a well comprising a mandrel, an outer sleeve slidably disposed about the mandrel, an inner sleeve slidably disposed in the mandrel; and a drive pin extending from the outer sleeve through the mandrel and into the inner sleeve. The drive pin comprises a drive pin bushing connected to the outer sleeve and extending into the mandrel and a shear pin connected to the inner sleeve and extending therefrom into an opening defined in the drive pin bushing.

Embodiment 2. The downhole tool of embodiment 1, the shear pin comprising a shear pin head threaded to the inner sleeve and a shear pin shank connected to the shear pin head and extending into the opening in the drive pin bushing.

Embodiment 3. The downhole tool of either of embodiments 1 and 2, the drive pin defining a shear plane across which the drive pin will shear between the inner sleeve and the mandrel.

Embodiment 4. The downhole tool of any of embodiments 1-3, the mandrel defining a slot therein, the drive pin bushing extending through the slot and movable therein.

Embodiment 5. The downhole tool of any of embodiments 1~4 comprising the inner and outer sleeves movable together from first to second positions and the inner sleeve movable relative to the outer sleeve and the mandrel to a third position upon the application to the inner sleeve of a force sufficient to shear the shear pin.

Embodiment 6. The downhole tool of any of embodiments 1-5, further comprising a packer disposed about the mandrel, the packer being moved from an unset to a set position on the mandrel in which the packer engages the well when the outer sleeve moves from a first to a second position on the mandrel.

Embodiment 7. The downhole tool of any of embodiments 1-6, the drive pin bushing having a higher bearing strength than the shear pin.

Embodiment 8. A downhole tool for use in a well comprising a mandrel defining a slot therein, an outer sleeve slidable on the mandrel from a first to a second position of the outer sleeve on the mandrel, an inner sleeve disposed in the mandrel and movable with the outer sleeve from a first to a second position of the inner sleeve, and a multiple piece drive pin connecting the inner sleeve to the outer sleeve. The drive pin comprises a drive pin bushing connected to the outer mandrel and a shear pin connected to and extending from the inner sleeve into an opening in the drive pin bushing, the shear pin and drive pin bushing being made from different materials.

Embodiment 9. The downhole tool of embodiment 8, further comprising a packer disposed about the mandrel and a flow port defined in the mandrel, the packer moved to a set position against the well when the outer sleeve moves from the first to the second position.

Embodiment 10. The downhole tool of embodiment 9, the inner sleeve covering the flow port in the first and second positions thereof, and movable relative to the mandrel and the outer sleeve to a third position in which the flow port is uncovered, the inner sleeve being movable to the third position upon the application of a force thereto sufficient to shear the shear pin.

Embodiment 11. The downhole tool of any of embodiments 8-10, the drive pin defining a shear plane between the inner sleeve and the mandrel across which the drive pin shears upon the application of a predetermined force to the inner sleeve.

Embodiment 12. The downhole tool of any of embodiments 8-11, the drive pin bushing comprising a cap portion threadedly connected in the outer mandrel and a plurality of seals disposed about the cap portion and sealingly engaging the cap portion and the outer sleeve.

Embodiment 13. The downhole tool of any of embodiments 8-12, the drive pin bushing having a greater shear strength than the shear pin.

Embodiment 14. The downhole tool of any of embodiments 8-13, the drive pin bushing being threadedly connected to the outer sleeve and the shear pin being threadedly connected to the inner sleeve.

Embodiment 15. A downhole tool comprising a mandrel, an outer sleeve disposed about the mandrel and movable from a first to a second position on the mandrel, a packer disposed about the mandrel, the packer movable to a set position upon the outer sleeve moving to the second position and an inner sleeve connected to the outer sleeve with a drive pin and movable with the outer sleeve from the first to the second position, the inner sleeve movable from the second to a third position upon the breaking of the drive pin. The drive pin comprises a drive pin bushing connected to the outer sleeve and a shear pin connected to the inner sleeve and extending into the drive pin.

Embodiment 16. The downhole tool of embodiment 15, the mandrel defining a longitudinal slot in which the drive pin travels, the drive pin bushing configured to extend into the longitudinal slot in the mandrel.

Embodiment 17. The downhole tool of any of embodiments 15-16, the drive pin configured to shear along a plane between the inner sleeve and the mandrel.

Embodiment 18. The downhole tool of any of embodiments 15-17, the drive pin bushing having a higher shear strength than the shear pin.

Embodiment 19. The downhole tool of any of embodiments 15-18, the drive pin bushing being threaded to the outer sleeve.

Embodiment 20. The downhole tool of any of embodiments 15-19, the shear pin being threaded to the inner sleeve and extending into a cylindrical opening defined by the drive pin bushing.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole tool for use in a well comprising:
a mandrel;
an outer sleeve slidably disposed about the mandrel and movable thereon;
an inner sleeve slidably disposed in the mandrel and movable therein, the mandrel being sandwiched between the outer sleeve and inner sleeve, the inner and outer sleeves being movable together relative to the mandrel from first to second positions; and
a drive pin extending from the outer sleeve through the mandrel and into the inner sleeve, the drive pin comprising:
a drive pin bushing connected to the outer sleeve and extending into the mandrel; and
a shear pin connected to the inner sleeve and extending therefrom into an opening defined in the drive pin bushing.

2. The downhole tool of claim 1, the shear pin comprising:
a shear pin head threaded to the inner sleeve; and
a shear pin shank connected to the shear pin head and extending into the opening in the drive pin bushing.

3. The downhole tool of claim 1, the drive pin defining a shear plane across which the drive pin will shear between the inner sleeve and the mandrel.

4. The downhole tool of claim 1, the mandrel defining a slot therein, the drive pin bushing extending through the slot and movable therein.

5. The downhole tool of claim 4 comprising:
the inner sleeve movable relative to the outer sleeve and the mandrel to a third position upon the application to the inner sleeve of a force sufficient to shear the shear pin.

6. The downhole tool of claim 1, further comprising a packer disposed about the mandrel, the packer being moved from an unset to a set position on the mandrel in which the packer engages the well when the outer sleeve moves from a first to a second position on the mandrel.

7. The downhole tool of claim 1, the drive pin bushing having a higher bearing strength than the shear pin.

8. A downhole tool for use in a well comprising:
a mandrel defining a slot therein;
an outer sleeve slidable on an outer surface of the mandrel from a first to a second position of the outer sleeve on the mandrel;
an inner sleeve disposed in the mandrel and movable together with the outer sleeve relative to the mandrel from a first to a second position of the inner sleeve, the mandrel being sandwiched between the inner sleeve and the outer sleeve; and
a multiple piece drive pin connecting the inner sleeve to the outer sleeve, the drive pin comprising:
a drive pin bushing connected to the outer sleeve; and
a shear pin connected to and extending from the inner sleeve into an opening in the drive pin bushing, the shear pin and drive pin bushing being made from different materials.

9. The downhole tool of claim 8, further comprising:
a packer disposed about the mandrel; and
a flow port defined in the mandrel, the packer moved to a set position against the well when the outer sleeve moves from the first to the second position.

10. The downhole tool of claim 9, the inner sleeve covering the flow port in the first and second positions thereof, and movable relative to the mandrel and the outer sleeve to a third position in which the flow port is uncovered, the inner sleeve being movable to the third position upon the application of a force thereto sufficient to shear the shear pin.

11. The downhole tool of claim 8, the drive pin defining a shear plane between the inner sleeve and the mandrel across which the drive pin shears upon the application of a predetermined force to the inner sleeve.

12. The downhole tool of claim 8, the drive pin bushing comprising:
a cap portion threadedly connected in the outer sleeve; and
a plurality of seals disposed about the cap portion and sealingly engaging the cap portion and the outer sleeve.

13. The downhole tool of claim 8, the drive pin bushing having a greater shear strength than the shear pin.

14. The downhole tool of claim 8, the drive pin bushing being threadedly connected to the outer sleeve and the shear pin being threadedly connected to the inner sleeve.

15. A downhole tool comprising:
a mandrel;
an outer sleeve disposed about the mandrel and movable from a first to a second position on the mandrel;
a packer disposed about the mandrel, the packer movable to a set position upon the outer sleeve moving to the second position; and
an inner sleeve connected to the outer sleeve with a drive pin and movable inside the mandrel, the inner sleeve movable with the outer sleeve from the first to the second position, the inner sleeve movable from the second to a third position inside the mandrel upon the breaking of the drive pin, the drive pin comprising:
a drive pin bushing connected to the outer sleeve; and
a shear pin connected to the inner sleeve and extending into the drive pin.

16. The downhole tool of claim 15, the mandrel defining a longitudinal slot in which the drive pin travels, the drive pin bushing configured to extend into the longitudinal slot in the mandrel.

17. The downhole tool of claim 16, the drive pin configured to shear along a plane between the inner sleeve and the mandrel.

18. The downhole tool of claim 15, the drive pin bushing having a higher shear strength than the shear pin.

19. The downhole tool of claim 15, the drive pin bushing being threaded to the outer sleeve.

20. The downhole tool of claim 19, the shear pin being threaded to the inner sleeve and extending into a cylindrical opening defined by the drive pin bushing.

* * * * *